United States Patent [19]

Navarra

[11] 3,931,652

[45] Jan. 13, 1976

[54] INFANT BATHING APPARATUS

[76] Inventor: Barry A. Navarra, c/o Port-O-Tub Inc., 214 Old Nyack Turnpike, Spring Valley, N.Y. 10977

[22] Filed: Mar. 20, 1975

[21] Appl. No.: 560,167

[52] U.S. Cl. ..... 4/177; 4/177 IW; 4/185 R; 4/DIG. 18

[51] Int. Cl.[2] ..... A47K 3/064; A47K 3/06

[58] Field of Search .. 4/187, DIG. 18, 177, 177 IW, 4/173–175, 185 R, 185 S, 166, 167

[56] References Cited

UNITED STATES PATENTS

| | | | |
|---|---|---|---|
| 2,806,227 | 9/1957 | Arbetter | 4/187 |
| 2,817,851 | 12/1957 | Barnwell | 4/166 |
| 2,853,714 | 9/1958 | Darmstadt | 4/173 |
| 3,058,122 | 10/1962 | McDaniel et al. | 4/177 |
| 3,409,917 | 11/1968 | Howard | 4/177 |

FOREIGN PATENTS OR APPLICATIONS

| | | | |
|---|---|---|---|
| 742,969 | 1/1956 | United Kingdom | 4/177 IW |

*Primary Examiner*—Henry K. Artis
*Attorney, Agent, or Firm*—Peter L. Tailer

[57] ABSTRACT

An inflatable liner for a standard kitchen sink has a bottom, sides, and ends formed from contiguous inflatable ribs. The sides and ends are formed from horizontal ribs which extend above the level of the sink. An inflatable pillow with an air valve in its lower side extends from one end of the liner to rest on the sink top. A drain is formed in the end of the bottom of the liner opposite the pillow. The liner, when used with a sink, provides a tub for bathing infants.

2 Claims, 3 Drawing Figures

Fig. 1.
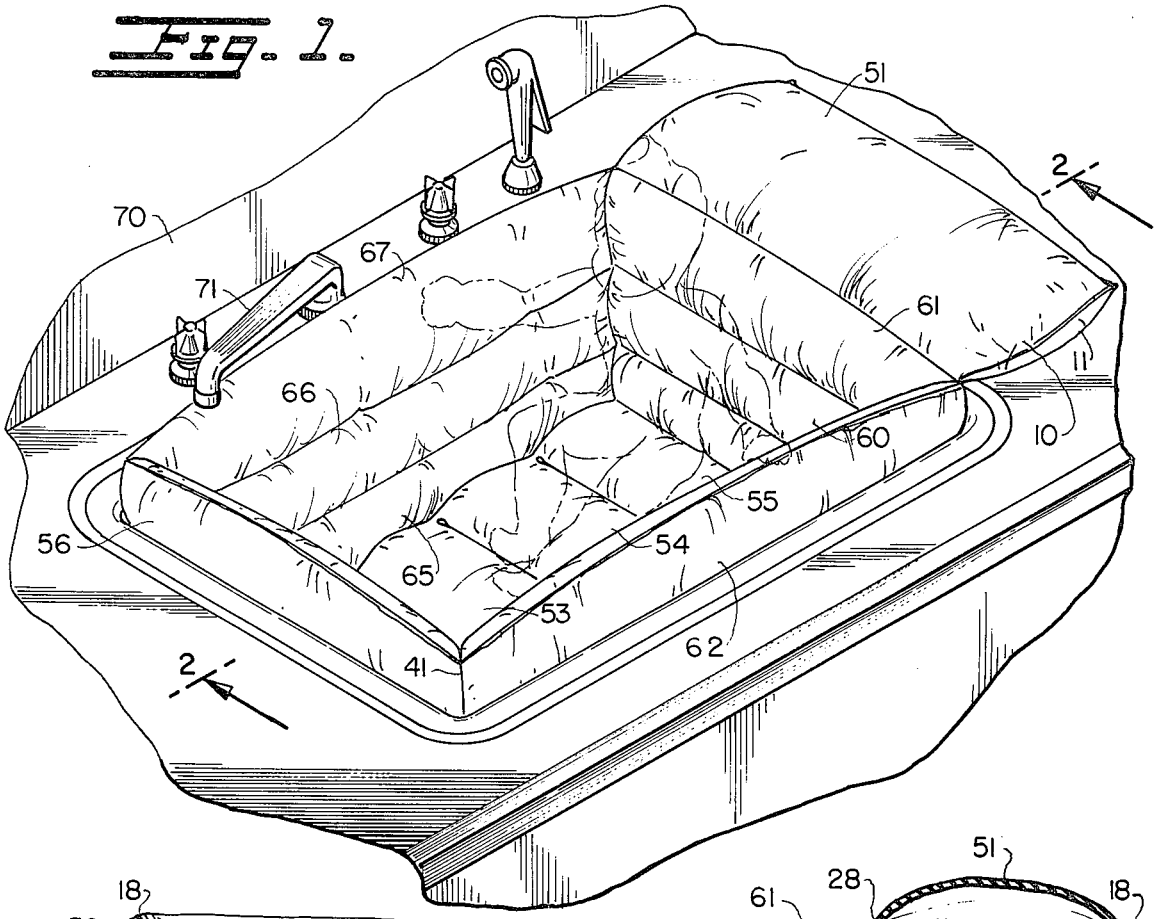
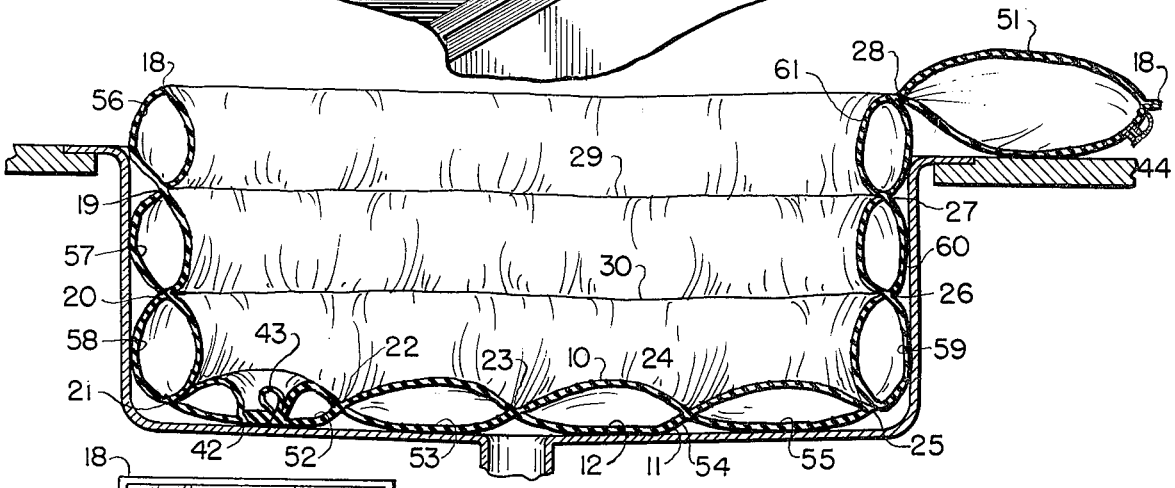
Fig. 2.
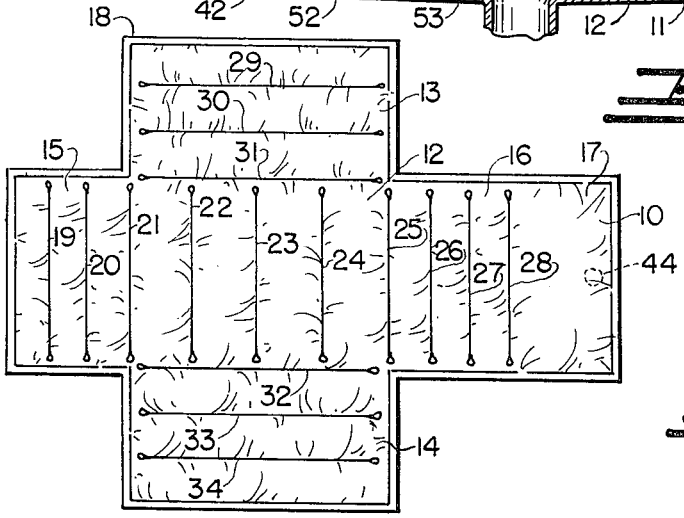
Fig. 3.

INFANT BATHING APPARATUS

BACKGROUND OF THE INVENTION

Tubs for bathing babies are large and bulky and thus difficult to store. In addition, they are usually of hard materials or incorporate hard elements which may injure or cause discomfort to delicate newborn infants. The bathing apparatus of this invention is easily stored and very safe to use.

BRIEF DESCRIPTION OF THE DRAWING

FIG. 1 is a perspective view of a standard kitchen sink containing infant bathing apparatus according to my invention, an infant being shown therein in phantom lines;

FIG. 2 is vertical section taken on line 2—2 of FIG. 1; and

FIG. 3 is a plan view of the infant bathing apparatus of my invention during its fabrication.

DESCRIPTION OF THE PREFERRED EMBODIMENT

As shown in FIGS. 2 and 3, two layers 10 and 11 of flexible vinyl sheet material of the like are cut in cruciform shapes and placed one over the other. Each layer 10 and 11 has a rectangular bottom portion 12, side portions 13 and 14, and end portions 15 and 16. The end portions 16 have the extension 17.

The layers 10 and 11 are electronically welded or otherwise sealed at their cruciform peripheries 18, on the transverse line welds 19–28, and on the longitudinal line welds 29–34. The transverse line welds 19–28 end short of the periphery 18 and the longitudinal line welds 31 and 32. The longitudinal line welds 29–34 also end short of the periphery 18. The ends 15 and 16 and the sides 13 and 14 are folded upward and welded together along vertical welds 41 as may be seen in FIG. 1. A drain 42 in bottom 12 is provided with a stopper 43. Layer 11 contains a mouth inflation valve 44 in extension 17.

Referring now to FIGS. 1 and 2, air is blown into valve 44 inflating extension 17 into pillow 51. Air then flows around the line welded areas 25–28 to form the inflated transverse bottom ribs 52–55 in bottom portion 12, and the horizontal ribs 56–61 and 62–67 in ends 15 and 16 and sides 13 and 14.

The inflated baby bathing apparatus is either placed in a conventional sink 70, or the apparatus is placed in the kitchen sink 70 and then inflated therein. Stopper 43 is placed in drain 42 and the apparatus is filled from sink faucet 71 to provide a safe baby bath. On completion, the apparatus is drained, deflated, wiped dry, and stored.

The inflation valve 44 is placed under pillow 51 where it is easy to reach by merely raising pillow 51 povoting it about line weld 28. Placing valve 44 under pillow 51 prevents it from being accidently touched which could result in the deflation of the apparatus while in use. The upper horizontal ribs 56, 61, 62 and 67 extend above the edge of a standard kitchen sink 70 to completely cushion an infant from any possible contact with hard surfaces. The drain 42 with its stopper 43 is placed opposite pillow 51 so that, when properly seated, an infant will not come in contact with the drain 42.

While this invention has been shown and described in the best form known, it will nevertheless be understood that this is purely exemplary and that modifications can be made without departing from the spirit of the invention.

I claim:

1. Baby bathing apparatus for use with a standard kitchen sink comprising, in combination, upper and lower layers of flexible material, cruciform shapes cut from said upper and lower layers of material with said cruciform shapes each having a bottom portion and sides and ends extending therefrom, extensions from one end of each cruciform shape, peripheral welds joining the peripheries of said cruciform shapes, transverse spaced apart line welds joining said layers together within said bottom portions and said ends of said cruciform shapes, longitudinal spaced apart line welds joining said layers together within said sides of said cruciform shapes, said line welds terminating short of the peripheries of said cruciform shapes, a mouth inflation valve in one of said extensions, said valve inflating said apparatus with said bottom portions inflating as contiguous transverse ribs forming the bottom of said apparatus, with said sides and ends of said cruciform shapes inflating as horizontal contiguous ribs forming sides and ends of said apparatus, and with said extensions inflating as a pillow resting at the end of the sink, said bottom of said apparatus having one end opposite said pillow containing a drain, a stopper for said drain, and vertical welds joining adjacent sides and ends of said apparatus, said uppermost of said horizontal ribs extending above the sink.

2. The combination according to claim 1 wherein said valve is in said lower layer disposed on the underside of said pillow.

* * * * *